US006179978B1

(12) United States Patent
Hirsh et al.

(10) Patent No.: US 6,179,978 B1
(45) Date of Patent: Jan. 30, 2001

(54) MANDREL FOR FORMING A NOZZLE PLATE HAVING A NON-WETTING SURFACE OF UNIFORM THICKNESS AND AN ORIFICE WALL OF TAPERED CONTOUR, AND METHOD OF MAKING THE MANDREL

(75) Inventors: Jeffrey I. Hirsh, Rochester; Edwin A. Mycek, Scottsville; Larry L. Lapa, Rochester, all of NY (US)

(73) Assignee: Eastman Kodak Company, Rochester, NY (US)

( * ) Notice: Under 35 U.S.C. 154(b), the term of this patent shall be extended for 0 days.

(21) Appl. No.: 09/249,831

(22) Filed: Feb. 12, 1999

(51) Int. Cl.[7] ..... C25D 1/00
(52) U.S. Cl. ..... 204/281; 205/67; 205/73
(58) Field of Search ..... 204/281; 205/73, 205/67

(56) References Cited

U.S. PATENT DOCUMENTS

| | | | |
|---|---|---|---|
| 4,264,714 | 4/1981 | Trausch | 430/320 |
| 5,208,604 | 5/1993 | Watanabe et al. | 346/1.1 |
| 5,208,980 | 5/1993 | Hayes | 29/890.1 |
| 5,759,421 | 6/1998 | Takemoto et al. | 216/27 |

*Primary Examiner*—Bruce F. Bell

(74) *Attorney, Agent, or Firm*—Walter S. Stevens

(57) ABSTRACT

A mandrel for forming an inkjet printer nozzle plate having a non-wetting surface of uniform thickness and an orifice wall of tapered contour, and method of making the mandrel. A metal masking layer is deposited on a glass substrate, the masking layer having an opening therethrough for passage of light only through the opening. Next, a negative photoresist layer is deposited on the masking layer, the negative photoresist layer being capable of photochemically reacting with the light. A light source passes light through the substrate, so that the light also passes only through the opening in the form of a tapered light cone. This tapered light cone will define the tapered contour of a nozzle plate orifice wall to be formed. The negative photoresist layer photochemically reacts with the light only in the light cone to define a light-exposed region of hardened negative photoresist. The negative photoresist layer is thereafter developed to remove negative photoresist surrounding the light-exposed region, so as to define a column of negative photoresist extending into the opening. A layer of non-wetting material is then electroless deposited on the masking layer. A nozzle plate material is now electrodeposited on the non-wetting layer. Next, the column is removed by a solvent and the nozzle plate material having the non-wetting layer adhering thereto is released from the masking layer. In this manner, the nozzle plate having the non-wetting layer of uniform thickness and the orifice wall of tapered contour is made.

7 Claims, 7 Drawing Sheets

MANDREL FOR FORMING A NOZZLE PLATE HAVING A NON-WETTING SURFACE OF UNIFORM THICKNESS AND AN ORIFICE WALL OF TAPERED CONTOUR, AND METHOD OF MAKING THE MANDREL

BACKGROUND OF THE INVENTION

This invention generally relates to apparatus and methods of forming inkjet print head nozzle plates and more particularly relates to a mandrel for forming an inkjet print head nozzle plate having a non-wetting surface of uniform thickness and an orifice wall of tapered contour, and method of making the mandrel.

An ink jet printer produces images on a receiver by ejecting ink droplets onto the receiver in an imagewise fashion. The advantages of non-impact, low-noise, low energy use, and low cost operation in addition to the capability of the printer to print on plain paper are largely responsible for the wide acceptance of ink jet printers in the marketplace.

In one type of "drop on demand" ink jet printer, a print head formed of piezoelectric material includes a plurality of ink channels, each channel containing ink therein. In such a printer, each of these channels is defined by a pair of oppositely disposed sidewalls made of the piezoelectric material. Also, each of these channels terminates in a channel opening for exit of ink droplets onto a receiver disposed opposite the openings. The piezoelectric material possesses piezoelectric properties such that an electric field applied to a selected pair of the sidewalls produces a mechanical stress in the sidewalls. Thus, the pair of sidewalls inwardly deform as the mechanical stress is produced by the applied electric field. As the pair of sidewalls defining the channel inwardly deform, an ink droplet is squeezed from the channel. Some naturally occurring materials possessing such piezoelectric characteristics are quartz and tourmaline. The most commonly produced piezoelectric ceramics are lead zirconate titanate (PZT), barium titanate, lead titanate, and lead metaniobate. However, it is desirable that the ink droplet exiting the channel opening travels along a predetermined trajectory and that the droplet has a predetermined velocity and volume, so that the droplet lands on the receiver at a predetermined location to produce a pixel of a predetermined size.

Therefore, it is customary to attach a nozzle plate to the print head so that the ink droplet achieves the desired volume, velocity and trajectory. The nozzle plate has nozzle orifices therethrough aligned with respective ones of the channel openings. The purpose of the orifices is to produce ink droplets having the desired volume and velocity. Another purpose of the orifices is to direct each ink droplet along a trajectory normal (i.e., at a right angle) to the nozzle plate and thus normal to the receiver surface. To achieve these results, the diameter and interior contour of the nozzle orifices are controlled. If as-built diameter and/or interior contour of the nozzle orifice deviates from a desired diameter and contour, ink droplet trajectory, volume and velocity can vary from desired values. In other words, such a nozzle plate should ensure that the ink droplet exiting the channel opening will travel along the predetermined trajectory with the predetermined volume and velocity so that the droplet lands on the receiver at the predetermined location and produces a pixel of predetermined size. To accomplish this result, each orifice is preferably precisely dimensioned and internally contoured (e.g., tapered) as previously mentioned, so that each ink droplet exiting any of the orifices travels along the predetermined trajectory with predetermined volume and velocity. This result is important in order to avoid image artifacts, such as banding. Therefore, the technique used to make the nozzle plate should produce nozzle plate orifices that are precisely dimensioned and internally contoured to avoid such undesirable image artifacts.

Moreover, it is important that the exterior surface of the nozzle plate have a so-called "non-wetting" characteristic. That is, it is known that direction of ink droplet trajectory can deviate from a desired trajectory if the vicinity of the nozzle orifice becomes nonuniformly wet with ink. Furthermore, as the nozzle plate surface becomes increasingly wet with ink during use, the volume, velocity and trajectory characteristics of the ink drop can be affected. This results in an unintended variation in quality of the printed image. Additionally, an accumulation of ink on the nozzle plate surface may dry-out over a period of time. This affects the above-mentioned ink drop characteristics and may even cause blocking of the nozzle. Therefore, it is desirable that the vicinity of the nozzle orifice resist liquid ink accumulation. In addition, it is desirable that any non-wetting layer coated on the exterior surface of the nozzle plate have uniform thickness, so that the non-wetting characteristic is the same among nozzle orifices of a single nozzle plate.

Manufacturing processes for producing templates having irregularly shaped apertures are known. In this regard, a process for manufacture of templates is disclosed in U.S. Pat. No. 4,264,714 titled "Process For The Manufacture Of Precision Templates" issued Apr. 28, 1981 in the name of G ünter E. Trausch. The Trausch patent discloses a process for manufacture of precision flat parts utilizing a metallized glass carrier having a stencil etched thereon with a negative working photo resist laminated on the carrier. Exposure of the photo resist is achieved through the glass so that maximum intensity of light in the photo resist occurs at the junction between the photo resist and the glass carrier for maximum adhesion. The Trausch patent also discloses that irregularly shaped apertures can be generated by selective varied orientation of the glass carrier during the exposure. However, the Trausch patent does not disclose a process expressly for manufacturing a mandrel for forming an inkjet print head nozzle plate. Also, the Trausch patent does not disclose an inkjet print head nozzle plate having a non-wetting surface layer.

However, an inkjet nozzle plate having an ink-repellent coating layer is disclosed in U.S. Pat. No. 5,759,421 titled "Nozzle Plate For Ink Jet Printer And Method Of Manufacturing Said Nozzle Plate" issued Jun. 2, 1998 in the name of Kiyohiko Takemoto, et al. The Takemoto, et al. patent discloses that a nozzle plate is immersed into an electrolyte in which particles of a water-repellent high molecular resin are dispersed by electric charges to form an ink-repellent coating layer on the front surface of the nozzle plate. According to the Takemoto et al. patent, the ink-repellent coating layer is an eutectoid plating layer or a fluorine-containing high molecular water-repellent agent applied by sputtering or dipping. However, sputtering or dipping may not provide an ink-repellent coating having a uniform thickness. Thus, although the Takemoto et al. patent discloses a method of making a nozzle plate having an ink-repellent coating layer, the Takemoto et al. patent does not appear to disclose a method of making the nozzle plate such that the nozzle plate is ensured of having an ink-repellent coating layer of uniform thickness. In addition, it appears that if the ink-repellent coating layer of the Takemoto et al. patent is a polymer, then the layer may be prone to being abraded.

Moreover, it appears the Takemoto et al. patent requires additional processing steps after the nozzle plate is formed, thereby increasing fabrication costs. It would therefore be desirable to avoid these increased fabrication costs by elimination such additional fabrication steps.

Therefore, there has been a long-felt need to provide a mandrel for forming a nozzle plate having a non-wetting surface of uniform thickness and an orifice wall of tapered contour, and method of making the mandrel.

SUMMARY OF THE INVENTION

An object of the present invention is to provide a mandrel for forming an inkjet printer nozzle plate having a non-wetting surface of uniform thickness and an orifice wall of tapered contour, and method of making the mandrel.

With the above object in view, the invention resides in a method of making a mandrel for forming a nozzle plate having a non-wetting characteristic and an orifice wall of predetermined contour, comprising the steps of providing a first layer having an opening therethrough; forming a column extending into the opening, the column being shaped to define the predetermined contour of the orifice wall; depositing a second layer on the first layer until the second layer surrounds the column to a uniform first predetermined thickness, the second layer having the non-wetting characteristic; and depositing a nozzle plate material on the second layer until the nozzle plate material surrounds the column to a second predetermined thickness.

With the above object in view, the invention also resides in a mandrel for forming a nozzle plate having a non-wetting characteristic and an orifice wall of predetermined contour, comprising a first layer having an opening therethrough; a column extending into the opening, the column being shaped to define the contour of the orifice wall; and a second layer disposed on the first layer and surrounding the column to a uniform first predetermined thickness, the second layer having the non-wetting characteristic, whereby a nozzle plate material is capable of being disposed on the second layer and surrounding the column to a second predetermined thickness to form a nozzle plate having the non-wetting characteristic and the orifice wall of predetermined contour.

According to an exemplary embodiment of the present invention, a method of making a mandrel is provided for forming an inkjet print head nozzle plate having a non-wetting surface and an orifice wall of tapered contour. According to the method of the invention, a glass substrate is provided having a first side and a second side opposite the first side. The substrate is transparent to light passing therethrough from the first side to the second side. A metal masking layer is electrodeposited on the second side of the substrate, the masking layer having an opening therethrough for passage of light only through the opening. Next, a negative photoresist layer is deposited on the masking layer, the negative photoresist layer being capable of photochemically reacting with light. The thickness of the negative photoresist layer is at least that of the desired thickness of the formed nozzle plate. A light source disposed opposite the first side of the substrate is then operated so as to pass light through the substrate. The light passing through the substrate also passes only through the opening in the form of a funnel-shaped light cone so as to define the tapered contour of the nozzle plate orifice wall to be formed. The negative photoresist layer photochemically reacts with the light only in the light cone to define a light-exposed region of hardened negative photoresist. The negative photoresist layer is thereafter developed to remove negative photoresist surrounding the light-exposed region. This step of the method defines a column of negative photoresist extending into the opening. A layer of non-wetting material is then electroless deposited on the masking layer after developing the negative photoresist layer, the non-wetting layer having a non-wetting surface thereon. A nozzle plate material is now electrodeposited on the non-wetting layer. Next, the column is removed, such as by a suitable solvent, and the non-wetting layer is released from the masking layer. The non-wetting layer has the nozzle plate material adhering thereto. It is in this manner that the nozzle plate having the uniform non-wetting surface and the orifice wall of tapered contour is made.

A feature of the present invention is the provision of a non-wetting layer on a nozzle plate, the non-wetting layer having a uniform thickness.

An advantage of the present invention is that the non-wetting layer has uniform thickness for providing ink droplets of desired trajectory, volume and velocity.

Another advantage of the present invention is that use thereof provides a well-defined demarcation between nozzle plate material the non-wetting layer.

These and other objects, features and advantages of the present invention will become apparent to those skilled in the art upon a reading of the following detailed description when taken in conjunction with the drawings wherein there are shown and described illustrative embodiments of the invention.

BRIEF DESCRIPTION OF THE DRAWINGS

While the specification concludes with claims particularly pointing-out and distinctly claiming the subject matter of the present invention, it is believed the invention will be better understood from the following detailed description when taken in conjunction with the accompanying drawings wherein:

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
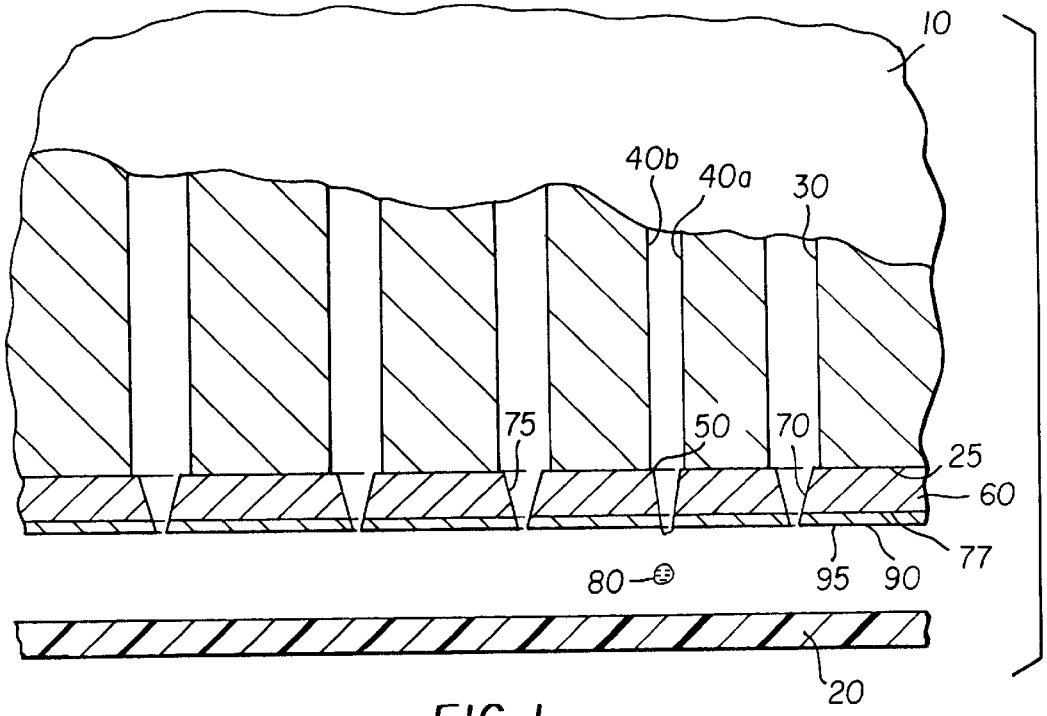
FIG. 1 is a view in partial elevation of a print head having a nozzle plate attached thereto, the nozzle plate having orifices therethrough of tapered contour and a non-wetting layer of uniform thickness thereon.

Therefore, referring to FIG. 1, there is shown a print head portion 10 for printing an image (not shown) on a receiver 20, which may be a reflective-type receiver (e.g., paper) or a transmissive-type receiver (e.g., transparency). Print head portion 10 has a surface 25 thereon. Formed in print head portion 10 are a plurality of spaced-apart parallel ink channels 30 (only five of which are shown), each channel 30 being defined by oppositely disposed sidewalls 40*a* and 40*b*. Each channel terminates in a channel outlet 50 opening onto surface 25, channel outlet 50 preferably being of generally oblong shape. Attached to surface 25, such as by a suitable adhesive, and extending along surface 25 is a nozzle plate, generally referred to as 60. Nozzle plate 60 includes a plurality of nozzle orifices 70 therethrough centrally aligned with respective ones of channel outlets 50. According to the invention, each orifice 70 obtains a precisely dimensioned diameter D (see FIG. 2) and has an interior wall 75 of predetermined tapered contour. That is, as shown in FIG. 1, each orifice 70 defines a funnel-shaped discharge throat converging almost immediately from a rear side of nozzle plate 60 toward a front side 77 of nozzle plate 60. It is important that each orifice 70 defines a funnel-shaped discharge throat. This is important because such a convergent funnel shape advantageously provides a sharp "pinch point" for an ink droplet 80 so that droplet 80 accurately and consistently forms when droplet 80 is discharged through orifice 70.

Referring again to FIG. 1, a "non-wetting" layer 90 defining a non-wetting surface 95 is laminated to front side 77 of nozzle plate 60 for resisting liquid ink accumulation in vicinity of orifice 70. Resistance to liquid ink accumulation in vicinity of orifice 70 substantially ensures that droplet 80 obtains desired trajectory, volume and velocity. Moreover, it is important that layer 90 be of uniform thickness. This is important for providing a consistent non-wetting characteristic between nozzle orifices 70 of single nozzle plate 60. Also, it is important that layer 90 be abrasion resistant in order to increase durability.

Still referring to FIG. 1, print head portion 10 is preferably formed of a piezoelectric material, such as lead zirconate titanate (PZT). This piezoelectric material possesses piezoelectric properties so that an electric field (not shown) applied to a selected pair of the sidewalls 40*a*/*b* produces a mechanical stress in the material. This pair of sidewalls 40*a*/*b* inwardly deform as the mechanical stress is produced by the applied electric field. As pair of sidewalls 40*a*/*b* inwardly deform, an ink droplet 80 is squeezed from the channel by way of orifice 70. However, it is desirable that ink droplet 80 exiting orifice 70 travels in a predetermined intended trajectory, so that droplet 80 lands on receiver at a predetermined location. Thus, nozzle plate 60 is provided to ensure that droplet 80 exiting orifice 70 will travel along the predetermined trajectory rather than along an unintended trajectory. Also, nozzle plate 60 ensures that droplet 80 obtains a predetermined volume so that droplet 80 produces a pixel of predetermined size and also ensures that droplet 80 obtains a predetermined velocity. It has been found that orifice diameter D and the non-wetting characteristic of surface 95 affect droplet trajectory, volume and velocity. By way of example only, and not by way of limitation, diameter D may be 20 microns. As described in detail hereinbelow, nozzle plate 60 is made by means of a mandrel produced by a photolithography process, such that nozzle plate 60 has orifices 70 of precise diameter D and also has non-wetting layer 90 of uniform thickness possessing the non-wetting characteristic.

Figure 2:
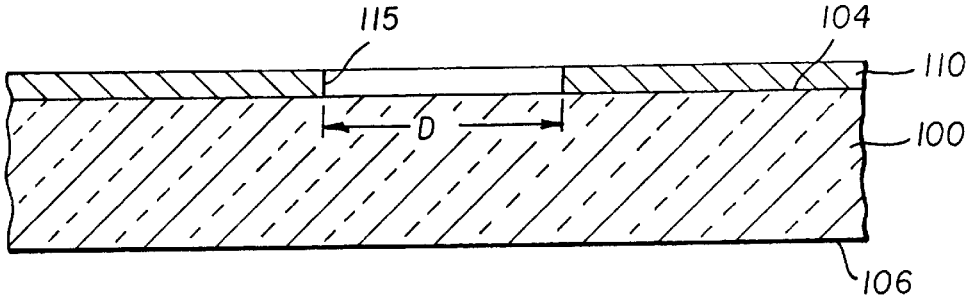
FIG. 2 is a view in elevation of a non-conducting substrate having a masking layer thereon, the masking layer having an opening therethrough.
Figure 3:
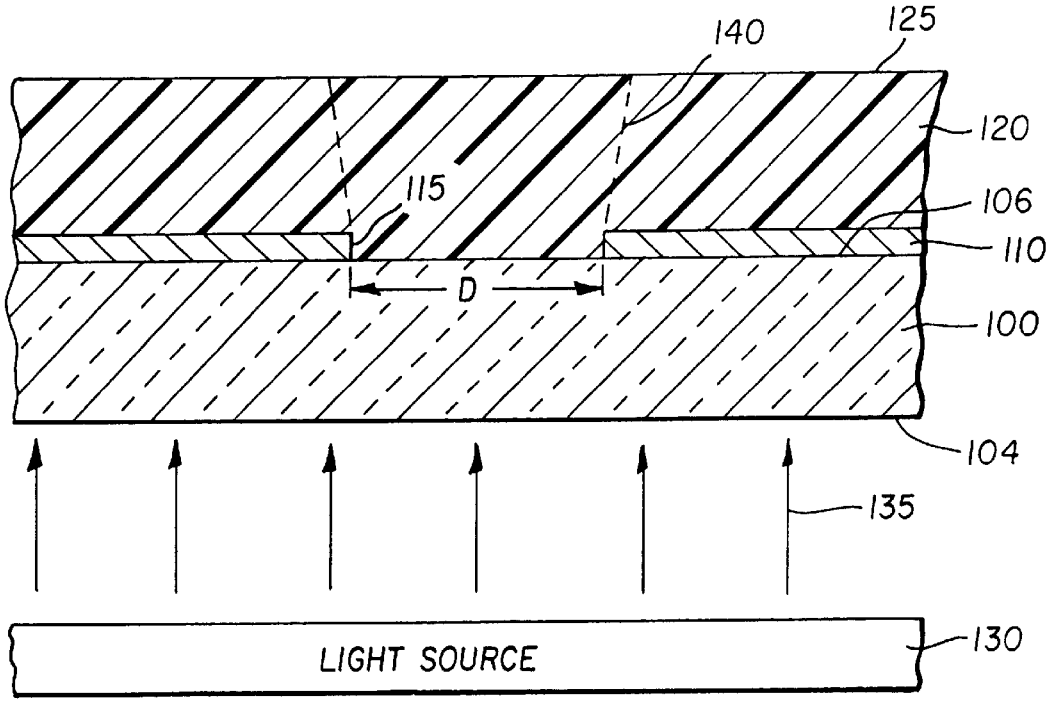
FIG. 3 is a view in elevation of the substrate and masking layer, the masking layer having a negative photoresist deposited thereon, this view also showing a light source directing a light beam into the substrate and through the opening to harden the photoresist in a predetermined region thereof.

Therefore, referring to FIGS. 2 and 3, a non-conducting substrate 100 is first provided. Substrate 100 is preferably glass or other dielectric material and has a first side 104 and a second side 106 opposite first side 104. Vacuum deposited in a continuous layer of uniform thickness on substrate 100 is a masking layer 110 (i.e., a first layer) having an opening 115 therethrough. Masking layer 110 is preferably a conductive metal, such as chromium, nickel, or other material suitable for plating and patterning. By way of example only, and not by way of limitation, thickness of masking layer 110 may be approximately 1000 Å (angstroms) or more. A light-sensitive negative photoresist layer 120 (i.e., a second layer) made of a photoresist resin and having a top surface 125 is deposited on masking layer 110 in a continuous layer of uniform thickness. By way of example only, and not by way of limitation, the negative photoresist resin may be monofunction methacrylates or multifunction methacrylates. Also, it may be appreciated that the terminology "light-sensitive" means that negative photoresist layer 120 hardens when exposed to light, such as ultraviolet light having a wavelength of approximately 365 nanometers (nm). During deposition of layer 120, the layer 120 will fill opening 115 as layer 120 is deposited on masking layer 110. Although thickness of photoresist layer 120 is not critical, photoresist layer 120 should be at least as thick as the desired thickness of the finished nozzle plate. By way of example only, and not by way of limitation, photoresist layer 120 may be approximately 25 to 30 microns thick.

As best seen in FIG. 3, a light source 130 is disposed opposite first side 104 of substrate 100 for passing a light beam 135 through substrate 100, which light beam 135 will travel through glass substrate 100 from first side 104 to second side 106 of substrate 100. As light beam 135 reaches second side 106 of substrate 100, light beam 135 passes only through opening 115 because light beam 135 is elsewhere blocked by masking layer 110. In addition, as light beam 135 passes through opening 115, light beam 135 defines a diverging funnel-shaped (i.e., tapered) light cone 140 extending from opening 115 to top surface 125 of negative photoresist layer 120. Moreover, portion of negative photoresist layer 120 captured within light cone 140 hardens due to a photo-chemical reaction occurring between this portion of layer 120 and light in light cone 140.

Figure 4:
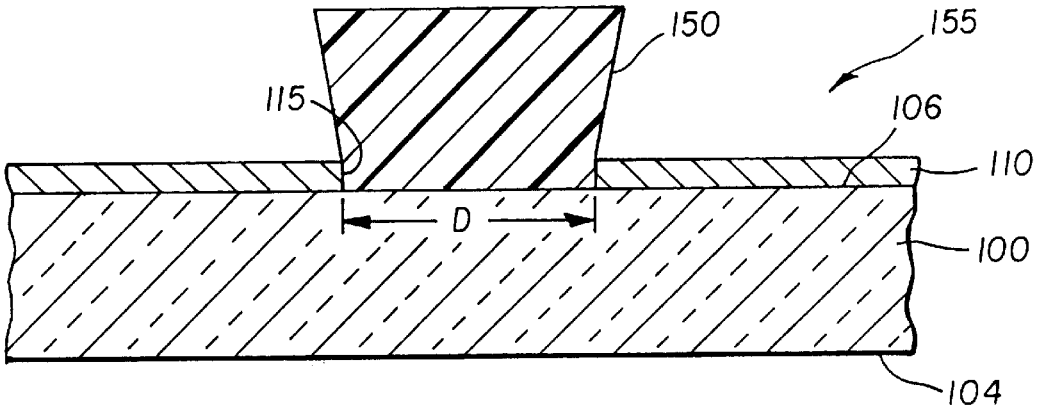
FIG. 4 is a view in elevation of a mandrel formed according to the invention, the mandrel including an outwardly projecting tapered column of light-hardened photoresist.
Figure 5:
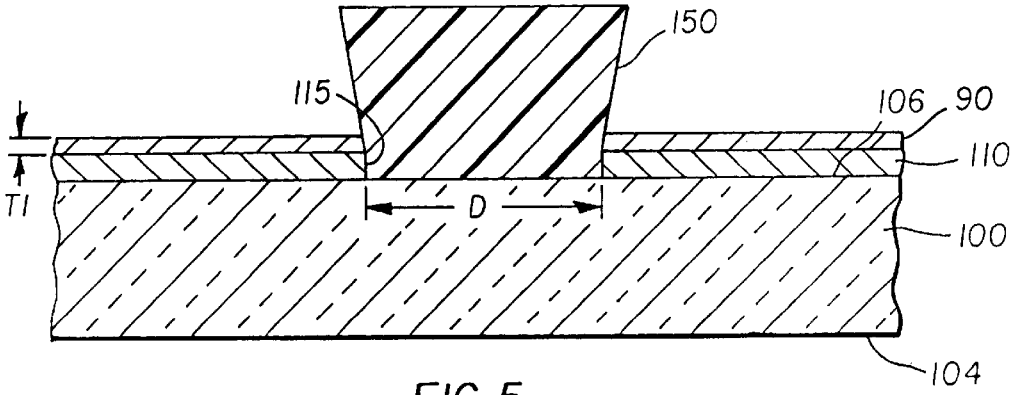
FIG. 5 is a view in elevation of the mandrel having a non-wetting layer deposited thereon, the non-wetting layer having a uniform first predetermined thickness.
Figure 6:
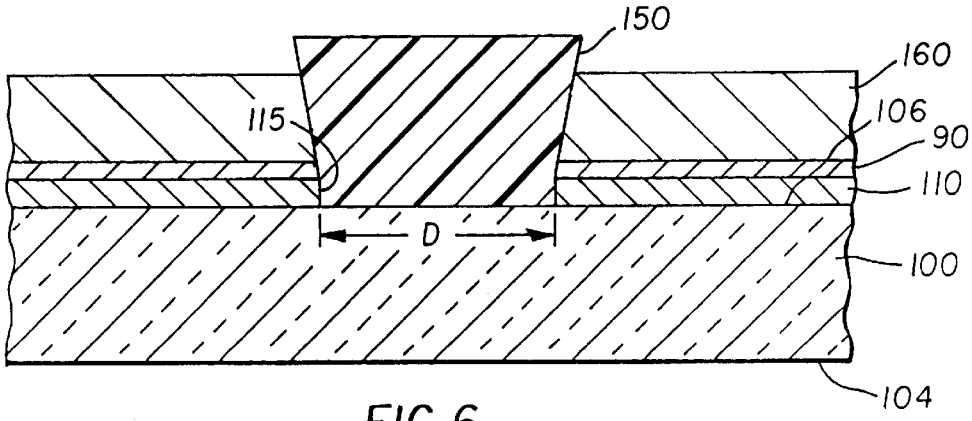
FIG. 6 is a view in elevation of the mandrel showing a nozzle plate material being deposited on the non-wetting layer.
Figure 7:
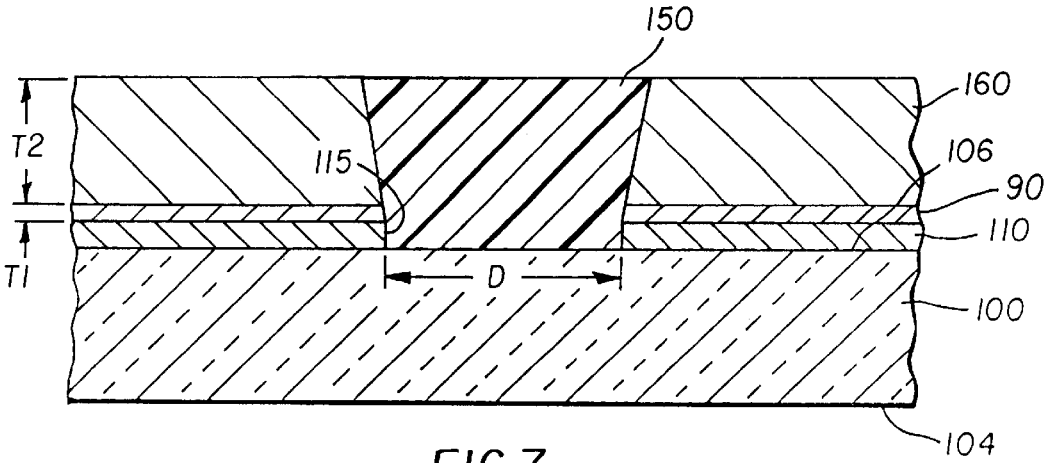
FIG. 7 is a view in elevation of the mandrel showing the nozzle plate material having been deposited to a second predetermined thickness.
Figure 8:
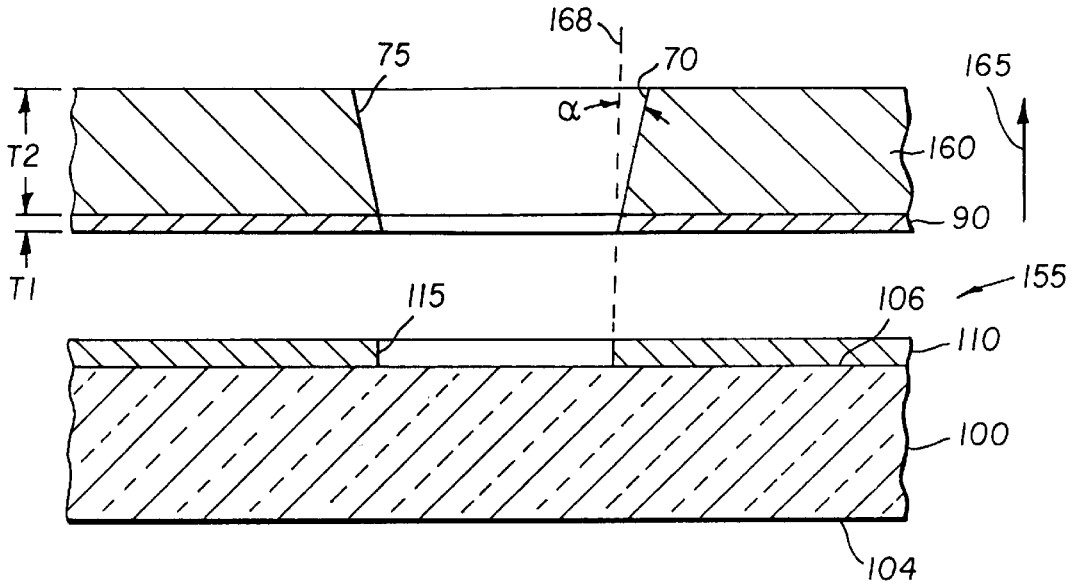
FIG. 8 is a view in elevation of a nozzle plate being released from the mandrel after removal of the column.

Referring to FIG. 4, negative photoresist layer 120 is developed, such as being subjected to a developer bath that dissolves that portion of negative photoresist layer 120 not exposed to light cone 140. A developer suitable for this purpose is an aqueous solution containing sodium carbonates. As layer 120 is dissolved, except for that portion exposed to light cone 140, a column 150 extending into opening 115 is defined for purposes disclosed hereinbelow. It is this configuration of the invention, as shown in FIG. 4, that provides a mandrel, generally referred to as 155, for making nozzle plate 60.

Referring now to FIGS. 5, 6, 7 and 8, previously mentioned non-wetting layer 90 is "electroless-deposited" on masking layer 110 to a predetermined thickness "T1". In this regard, by way of example only and not by way of limitation, thickness T1 may be approximately 1 to 3 microns. A layer 160 of nozzle plate material is now electrodeposited on non-wetting layer 90. In this regard, the nozzle plate material is preferably metal, such as nickel, chromium, tin, gold or the like. Alternatively, the nozzle plate material may be an alloy, such as nickel-phosphor alloy, tin-copper-phosphor alloy, or copper-zinc alloy. Moreover, the nozzle plate material alternatively may be ceramic, silicon, glass, plastic, or the like. Layer 160 is electrodeposited so as to cover non-wetting layer 90 to a predetermined thickness "T2". By way of example only, and not by way of limitation, thickness T2 may be approximately 25 microns. As layer 160 thickens, layer 160 defines the previously mentioned nozzle wall 75, which nozzle wall 75 has a funnel shape (i.e., tapered) conforming to the funnel shape of column 150. This electrodeposition step of layer 160 is terminated when thickness T2 is obtained. Nozzle plate 60 is separated from mandrel 155, such as by releasing (i.e., lifting or separating) nozzle plate 60 in direction of arrows 165. According to the invention, nozzle plate 60 now has orifices 70 of precise diameters D and non-wetting layer 90. It may be appreciated that according to the method of the invention, orifice wall 75 is inclined at a predetermined angle "$\alpha$" with respect to a vertical datum 168 for suitably ejecting previously mentioned ink droplet 80.

It may be appreciated from the description hereinabove, that non-wetting layer 90 is ensured of having a substantially uniform thickness TI so that surface 95 of layer 90 is substantially flat. It is important that layer 90 has substantially uniform thickness TI so that surface 95 of layer 90 is substantially flat. This is important for providing a consistent non-wetting characteristic between nozzle orifices 70 of single nozzle plate 60. In this regard, surface 95 is substantially flat because layer 90 is deposited on flat substrate 100 and conforms to contour of flat substrate 100. More importantly, uniform thickness T1 of layer 90 ensures that each of the opposing end portions of nozzle plate 60 has the same thickness of non-wetting material deposited on it. Otherwise, if thickness of layer 90 varied from one end of substrate 100 to the other end of nozzle plate 60; then, there would be more non-wetting material on one end of substrate 100. Such a non-uniform deposition of non-wetting material would undesirably affect ink drop characteristics. As previously mentioned, non-wetting layer 90 inherently resists liquid ink accumulation in vicinity of orifice 70. Resistance to liquid ink accumulation in vicinity of orifice 70 substantially ensures that droplet 80 obtains the desired trajectory, volume and velocity. Thus, it may be appreciated that the method of the present invention is an advancement over techniques of the prior art. This is so because prior art techniques, such as disclosed in U.S. Pat. No. 5,759,421, require additional processing steps in which the nozzle plate must be first selectively masked with a material, and then immersed into an electrolyte in which particles of a ink-repellent high molecular resin are dispersed by electric charges to form an ink-repellent coating layer on the front surface of the nozzle plate. Also, prior art techniques, such as disclosed in U.S. Pat. No. 5,759,421, alternatively use sputtering to deposit the ink-repellent coating on the nozzle plate. In addition to requiring additional processing steps after the nozzle plate has been formed, such prior art techniques risk that the ink-repellent coating may be deposited in an uneven (i.e., non-uniform) manner. Such prior art techniques also risk that the ink-repellent coating may coat interior portions of the nozzles. The present invention, on the other hand, deposits non-wetting layer 90 directly on masking layer 110, so that surface 95 is assured of being substantially flat across the entire nozzle plate 90 due to non-wetting layer 90 having a uniform thickness.

Figure 9:
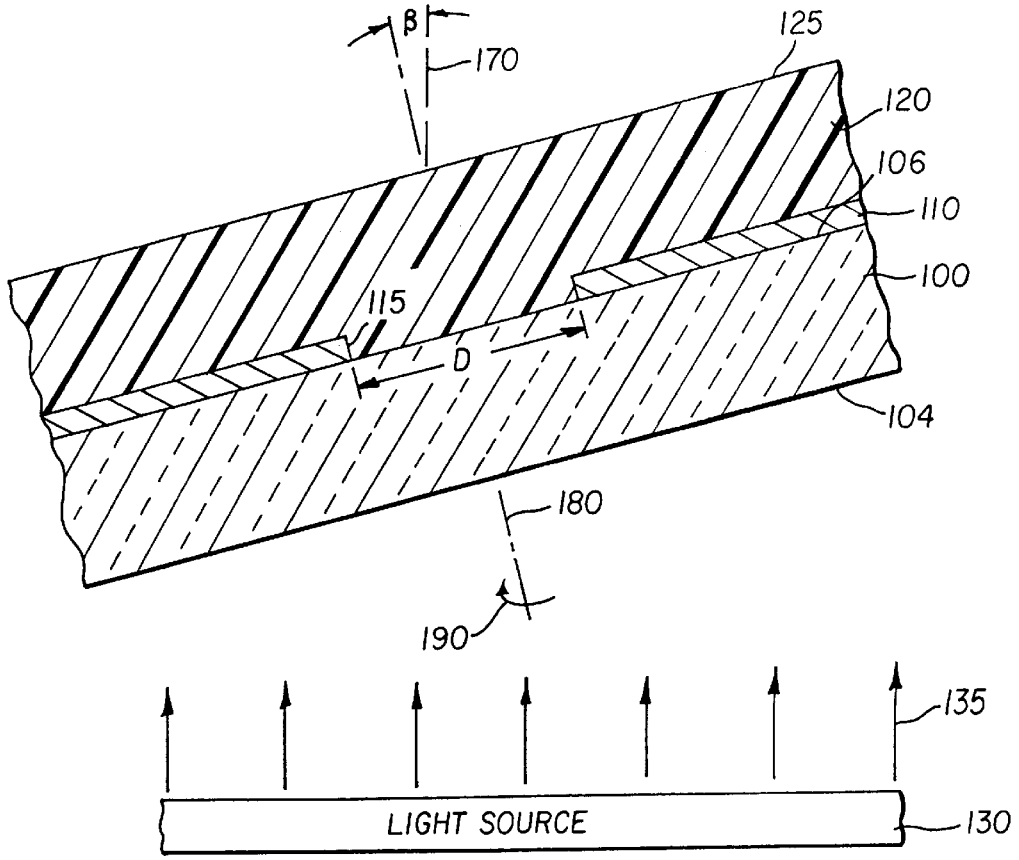
FIG. 9 is a view in elevation of a second embodiment of the present invention, showing a structure comprising the substrate, masking layer and negative photoresist being tilted at a predetermined angle with respect to a vertical axis in order to control amount of taper of the column.

Referring to FIG. 9, there is shown a second embodiment of the present invention. This second embodiment of the invention is substantially similar to the first embodiment of the invention, except that substrate 100 having masking layer 110 and negative photoresist 120 thereon is tilted at an angle "$\beta$" with respect to a vertical axis 170. Vertical axis 170 lays in the same direction as direction of vertically-oriented light beam 135. Moreover, substrate 100 having masking layer 110 and negative photoresist 120 thereon is rotated about a center axis 180 extending through the structure defined by substrate 100, masking layer 110 and negative photoresist 120 (as shown). For example, the structure defined by substrate 100, masking layer 110 and negative photoresist 120 is rotated in direction of second arrow 190. It may be appreciated that tilting the structure defined by substrate 100, masking layer 110 and negative photoresist 120 to the angle $\beta$ with respect to light beam 135 controls taper of orifice wall 75 for controlling trajectory, volume and velocity of droplet 80. The amount of exposure also affects taper. Moreover, rotation of the structure defined by substrate 100, masking layer 110 and negative photoresist 120 ensures that taper of orifice wall 75 is the same around interior of orifice 70.

Figure 10:
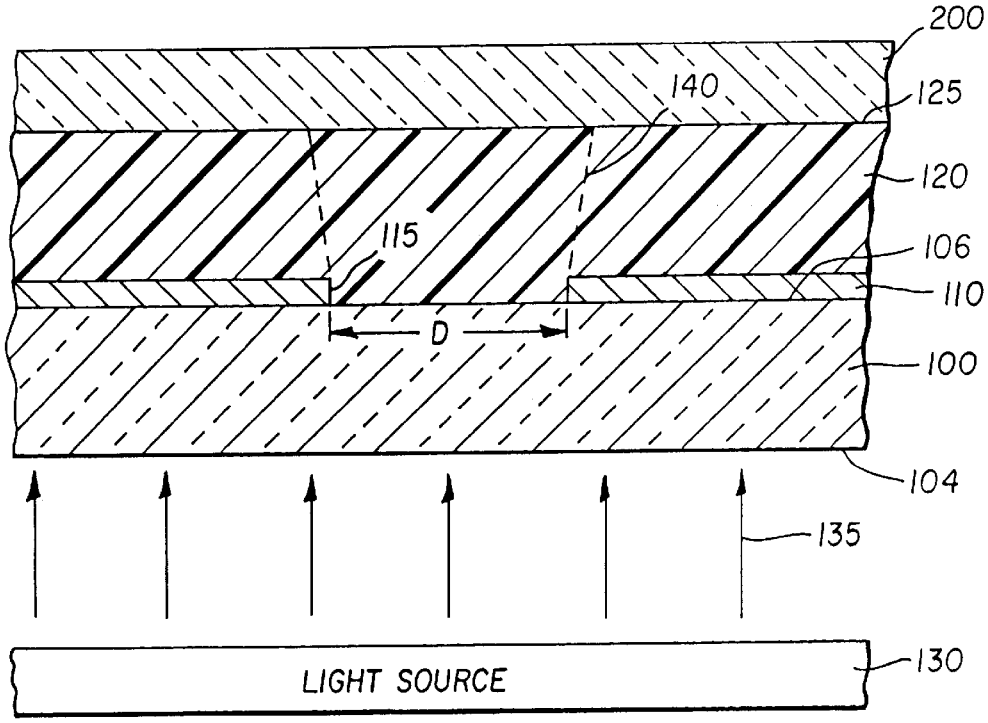
FIG. 10 is a view in elevation of a third embodiment of the present invention, showing a light-absorbing filter mounted atop the negative photoresist layer to absorb light otherwise reflected back into the photoresist layer, which would interfere with proper formation of the tapered column.

Turning now to FIG. 10, there is shown a third embodiment of the present invention. This third embodiment of the invention is substantially similar to the first embodiment of the invention, except that a light-absorbing filter 200 is removably mounted on top surface 125 of negative photoresist layer 120 during exposure of negative photoresist layer 120. Use of filter 200 is desirable for reasons described presently. In this regard, negative photoresist layer 120 may have a relatively high refractive index and, as previously mentioned light cone 140 exits opening 115 and reaches top surface 125, the light in light cone 140 may be reflected at the air-photoresist interface of top surface 125. The refractive index of negative photoresist layer may be, for example, approximately 1.5 to approximately 1.7. Such refraction and reflection will in turn cause unwanted exposure to take place in unintended regions of photoresist layer 120. This unwanted exposure will interfere with precise formation of column 150. Of course, imprecise formation of column 150 may cause orifice wall 75 to be tapered at an angle other than the desired angle α. Mounting of filter 200 atop negative photoresist layer 120 substantially avoids such reflection of light because filter 200 absorbs light otherwise reflected at the interface of top surface 125 and the surrounding atmosphere. In this regard, filter 200 may be an ultraviolet (UV) absorbing glass or other dielectric, whose refractive index closely matches that of the photoresist. The UV absorbing glass may also be "index matched" to the photoresist using a appropriate or a chemically compatible index matching fluid. Moreover, filter 200 may be a UV-absorbing "spin cast" top coat material designed to remove top surface reflections from the photoresist. One such spin cast top coat material suitable for this purpose is "AQUATAR" available from AZ Products, Incorporated, located in Dallas, Tex.

Figure 11:
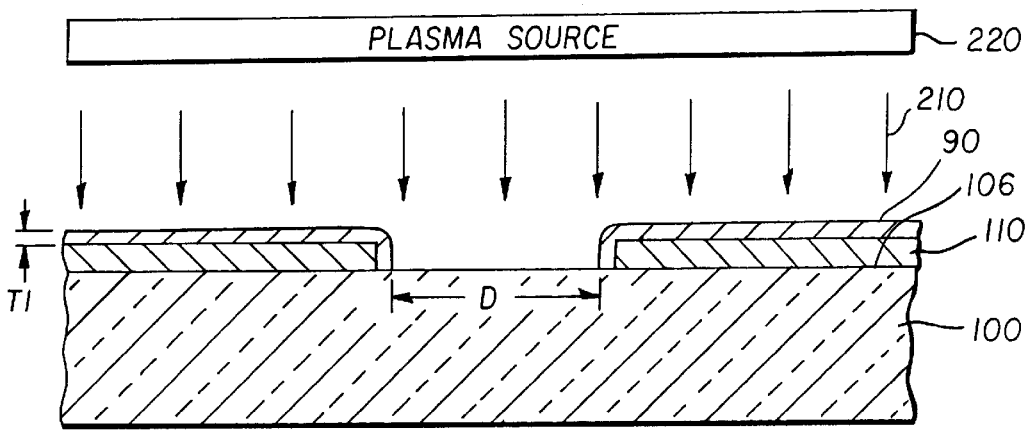
FIG. 11 is a view in elevation of a fourth embodiment of the present invention, wherein an oxygen/freon plasma etches a top surface of the non-wetting layer.

Referring to FIG. 11, there is shown a fourth embodiment of the present invention, wherein a dry-etching process is used to form nozzle plate 60. A purpose of the process defined by the fourth embodiment of the invention is to improve adhesion of nickel to the nickel- polytetrafluoroethylene. According to this fourth embodiment of the invention, masking layer 110 is laid-down on substrate 100 as in the first embodiment of the invention. Then, a nickel-polytetrafluoroethylene electroless layer 90 is deposited on masking layer 110 to a thickness of T1. A dry etch is performed to remove exposed polytetrafluoroethylene from the top surface of the nickel-polytetrafluoroethylene layer 90. The dry etch may also create "micropits" in the nickel, which micropits are helpful in improving adhesion of any subsequent layer. This dry etch may be performed by means of an oxygen/freon plasma. The direction of the oxygen/freon plasma is illustrated by vertical arrows 210. The plasma is produced by a plasma source 220. This step of the invention prepares the top surface of the nickel-polytetrafluoroethylene layer 90 so that the top surface of the nickelpolytetrafluoroethylene layer 90 can obtain the desired adherence of nozzle material 160 (e.g., nickel) growth on layer 90.

Figure 12:
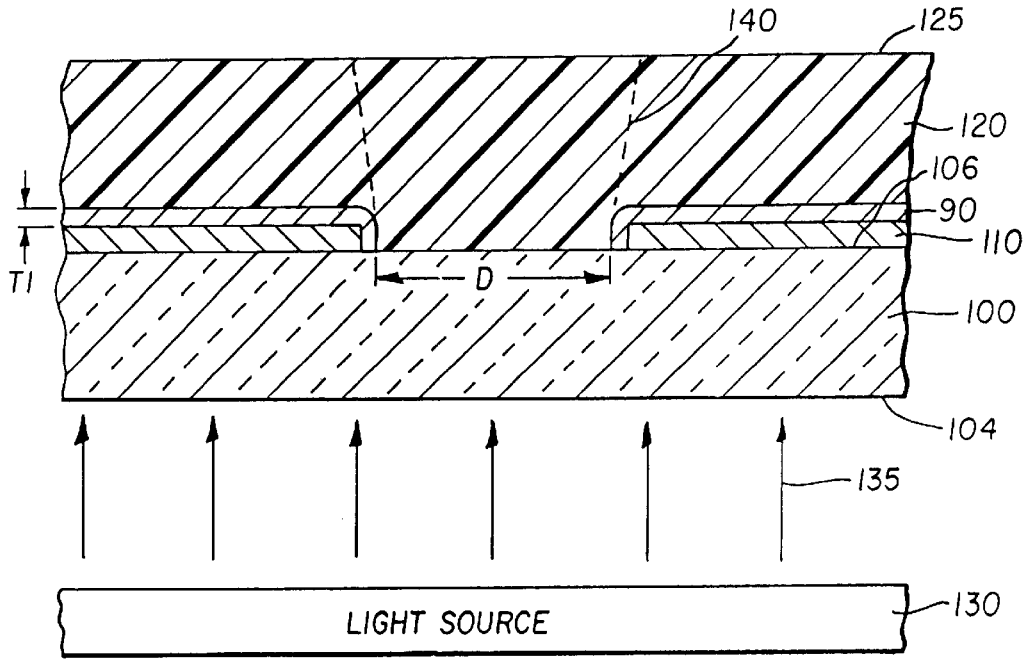
FIG. 12 is a view in elevation of the fourth embodiment of the present invention, wherein the masking layer has the negative photoresist deposited thereon, this view also showing the light source directing the light beam into the substrate and through the opening of the masking layer to harden the photoresist in a predetermined region thereof.
Figure 13:
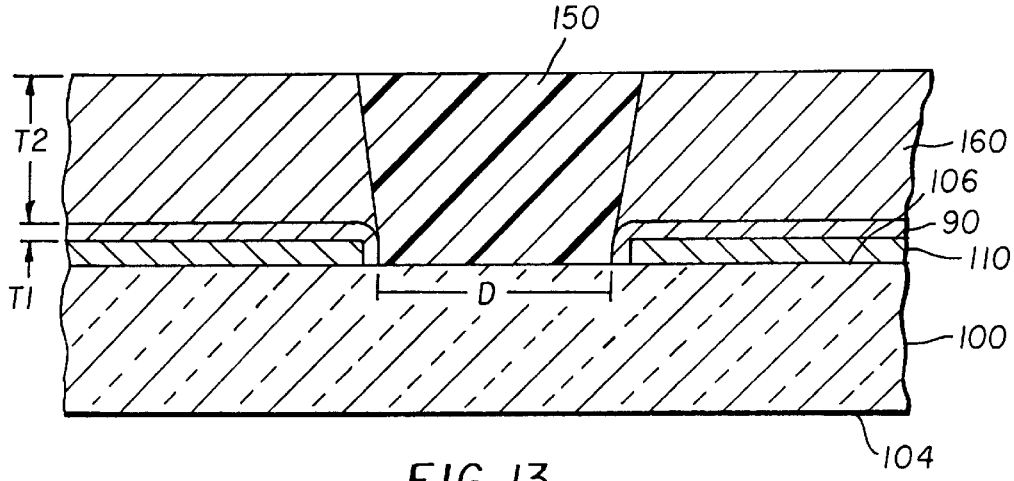
FIG. 13 is a view in elevation of a mandrel formed according to the fourth embodiment of the invention, the mandrel including an outwardly projecting tapered column of light-hardened photoresist and a nozzle plate material deposited on the non-wetting layer.
Figure 14:
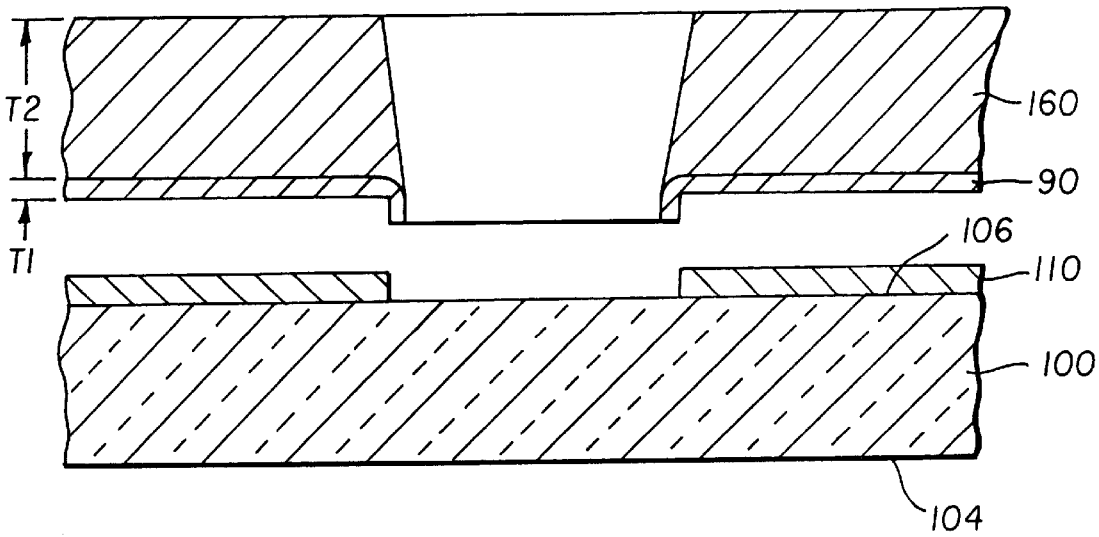
FIG. 14 is a view in elevation of the nozzle plate being released from the mandrel after removal of the column.

Referring to FIGS. 12, 13 and 14, photoresist layer 120 is then deposited on layer 90 and exposed to light beam 135 such that previously mentioned light cone 140 forms to define the column 150 of exposed photoresist. Next, photoresist layer 120 is developed such that only column 150 remains. Nozzle plate material 160 is then electrodeposited on layer 90 so as to surround column 50 (as shown). After this step, the finished nozzle plate 60 is removed and the photoresist is stripped. However, it is possible that the oxygen/freon plasma etch used to remove the polytetrafluoroethylene may also etch a portion of substrate 100 exposed to opening 115, especially if mandrel 155 is reused many times. This problem may be avoided, however, by forming substrate 100 from a material immune to the oxygen/freon plasma. Alternatively, substrate 100 may be coated with a transparent dielectric that does not etch in presence of freon. As yet another alternative, openings 115 may be covered with a transparent dielectric that does not etch in freon.

It may be appreciated from the description hereinabove, that an advantage of the present invention is that non-wetting layer 90 has uniform thickness T1 to provide ink droplets 80 of desired trajectory, volume and velocity. This is so because non-wetting layer 90 is deposited directly on masking layer 110, so that non-wetting layer 90 is assured of having substantially uniform thickness T1 across the entire surface 77 of nozzle plate 60.

It may be appreciated from the description hereinabove, that another advantage of the present invention is that use thereof provides a well-defined demarcation between nozzle plate material and the non-wetting layer. In this regard, providing a well-defined demarcation between nozzle plate material and the non-wetting layer facilitates achieving the following effects: (1) the non-wetting material will be uniform around the nozzle opening, and (2) the non-wetting layer will be uniform from nozzle to nozzle.

While the invention has been described with particular reference to its preferred embodiments, it will be understood by those skilled in the art that various changes may be made and equivalents may be substituted for elements of the preferred embodiments without departing from the invention. For example, with respect to the second embodiment of the invention, light source 130 may be tilted and rotated rather than tilting and rotating the structure defined by substrate 100, masking layer 110 and negative photoresist layer 120 to obtain similar results.

Therefore, what is provided is a mandrel for forming an inkjet printer nozzle plate having a non-wetting surface of uniform thickness and an orifice wall of tapered contour, and method of making the mandrel.

PARTS LIST

α . . . angle of inclination of orifice wall
α . . . angle of tilt of substrate
D . . . diameter of nozzle orifice and diameter of opening in substrate
T1 . . . thickness of non-wetting layer
T2 . . . thickness of nozzle plate material
10 . . . print head portion
20 . . . receiver
25 . . . surface on print head portion
30 . . . ink channels
40*a*/*b* . . . sidewalls
50 . . . channel outlet
60 . . . nozzle plate
70. . . nozzle orifice
75 . . . interior wall of nozzle orifice
77 . . . front side of nozzle plate
80 . . . ink droplet
90. . . non-wetting layer
95 . . . non-wetting surface
100 . . . substrate
104 . . . first side of substrate
106 . . . second side of substrate
110 . . . masking layer
115 . . . opening
120. . . negative photoresist layer
125 . . . top surface of negative photoresist layer
130 . . . light source
135 . . . light beam
140. . . light cone
150 . . . column
155 . . . mandrel
160 . . . layer of nozzle plate material
165 . . . first arrow
168 . . . vertical datum
170 . . . vertical axis
180 . . . center axis
190 . . . second arrow
200 . . . light-absorbing filter
210 . . . direction of oxygen/freon plasma
220 . . . plasma source

What is claimed is:

1. A mandrel for forming a nozzle plate having a non-wetting characteristic and an orifice wall of predetermined contour, comprising:

(a) a first layer having an opening therethrough;

(b) a column extending into the opening, the column being shaped to define the contour of the orifice wall; and (c) a second layer disposed on the first layer and contacting the column, the second layer having the non-wetting characteristic, whereby a nozzle plate material is capable of being disposed on the second layer and surrounding the column to a uniform first predetermined thickness to form a nozzle plate having the non-wetting characteristic and the orifice wall of predetermined contour.

2. A mandrel for forming a nozzle plate having a non-wetting surface and an orifice wall of tapered contour, comprising:

(a) a substrate;

(b) a first layer of metallic material disposed on the substrate, the first layer having an opening therethrough;

(c) a column extending into the opening, the column being tapered to define the tapered contour of the orifice wall; and (d) a second layer of non-wetting material disposed on the first layer and surrounding the column to a uniform first predetermined thickness, the second layer having the non-wetting surface, whereby a nozzle plate material is capable of being disposed on the second layer and surrounding the column to a second predetermined thickness, the second layer adhering to the nozzle plate material to form a nozzle plate having the non-wetting surface and the orifice wall of tapered contour.

3. A mandrel for forming a nozzle plate having a non-wetting surface and an orifice wall of tapered contour, comprising:

(a) a substrate having a first side and a second side opposite the first side, the substrate being transparent to light passing therethrough from the first side to the second side;

(b) a masking layer deposited on the second side of the substrate, the masking layer having an opening therethrough for passage of light only through the opening;

(c) a negative photoresist layer deposited on the masking layer, the negative photoresist layer capable of reacting with the light;

(d) a light source disposed opposite the first side of the substrate for passing the light through the substrate, so that the light passes only through the opening in the form of a light cone shaped to define the tapered contour of the orifice wall and so that the negative photoresist layer reacts with the light only in the light cone to define a light-exposed region of the negative photoresist;

(e) a column of negative photoresist extending into the opening formed by developing the negative photoresist layer to remove negative photoresist surrounding the light-exposed region;

(f) a non-wetting layer of non-wetting material electroless deposited on the first layer until the non-wetting layer surrounds the column to a uniform first predetermined thickness, the non-wetting layer having the non-wetting surface, whereby a nozzle plate material is capable of being electrodeposited on the non-wetting layer until the nozzle plate material surrounds the column to a second predetermined thickness, the second layer adhering to the nozzle plate material to form a nozzle plate having the non-wetting surface and the orifice wall of tapered contour after the column is removed.

4. The mandrel of claim 3, wherein the non-wetting layer is formed of a nickel and polytetrafluoroethlyene composition.

5. The mandrel of claim 3, (a) wherein the substrate is disposed at a predetermined angle with respect to the light source; and (b) wherein the substrate is rotatable about a predetermined axis thereof, whereby taper of the orifice wall is controlled while the substrate is disposed at the predetermined angle and rotated.

6. The mandrel of claim 3, further comprising a filter removably mounted on the negative photoresist layer for absorbing the light after the light forms the light cone.

7. A mandrel for forming a nozzle plate having a non-wetting surface, comprising:

(a) a substrate;

(b) a masking layer deposited on said substrate, said masking layer having an opening therethrough;

(c) a freon and oxygen plasma etched, electroless layer of nickel-polytetrafluoroethylene deposited on said masking layer; and (d) a photoresist layer deposited on said nickel layer, the photoresist layer extending into the opening.

* * * * *